US010246996B2

(12) United States Patent
Forstner et al.

(10) Patent No.: US 10,246,996 B2
(45) Date of Patent: Apr. 2, 2019

(54) ESTIMATION OF FORMATION PROPERTIES BASED ON FLUID FLOWBACK MEASUREMENTS

(71) Applicants: Ingo Forstner, Ahnsbeck (DE); Gerald Becker, Celle (DE)

(72) Inventors: Ingo Forstner, Ahnsbeck (DE); Gerald Becker, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 63 days.

(21) Appl. No.: 15/151,690

(22) Filed: May 11, 2016

(65) Prior Publication Data

US 2017/0328200 A1 Nov. 16, 2017

(51) Int. Cl.
*E21B 49/00* (2006.01)
*E21B 47/01* (2012.01)
*E21B 47/10* (2012.01)

(52) U.S. Cl.
CPC ..... *E21B 49/005* (2013.01); *E21B 47/01* (2013.01); *E21B 47/10* (2013.01); *E21B 49/008* (2013.01)

(58) Field of Classification Search
CPC ..... E21B 21/08; E21B 47/01; E21B 49/005
See application file for complete search history.

(56) References Cited

U.S. PATENT DOCUMENTS 6,230,822 B1 * 5/2001 Sullivan ..... E21B 10/08 175/228
2003/0062160 A1 4/2003 Boney et al.
2003/0140689 A1 7/2003 Demarchos et al.
2011/0125333 A1 5/2011 Gray
2012/0305314 A1 * 12/2012 Maida, Jr. ..... E21B 44/00 175/50
2013/0299242 A1 11/2013 Veeningen
2014/0110169 A1 4/2014 Santos et al.

OTHER PUBLICATIONS

Veeningen, et al.; "Better Well Control Through Safe Drilling Margin Identification, Influx Analysis and Direct Measurement Method for Deepwater";OTC24062; (2013); Offshore Technology Conference; 10 pages.

International Search Report and the Written Opinion of the International Searching Authority; PCT/US2017/031699; Korean Intellectual Property Office; dated Aug. 2, 2017; 13 pages.

* cited by examiner

*Primary Examiner* — Brad Harcourt
(74) *Attorney, Agent, or Firm* — Cantor Colburn LLP

(57) ABSTRACT

An apparatus for estimating properties of an earth formation includes a carrier connected to a drilling assembly, and a sensor assembly configured to measure at least one return flow parameter of a return fluid at a surface location, the return fluid returning to the surface location from a borehole. The apparatus also includes a processor configured to perform receiving one or more return flow parameter values for a period of time after injection of fluid is stopped, analyzing the one or more return flow parameter values to identify a ballooning event, in response to identifying the ballooning event, estimating at least one of a location and a property of one or more fractures in the formation, and performing one or more aspects of at least one of the drilling operation and a subsequent operation based on at least one of the location and the property of one or more fractures.

18 Claims, 10 Drawing Sheets

ESTIMATION OF FORMATION PROPERTIES BASED ON FLUID FLOWBACK MEASUREMENTS

BACKGROUND

Borehole drilling is performed to extract hydrocarbons from earth formations. During and after drilling, the formation may be evaluated using various sensing and measurement technologies to identify regions that contain hydrocarbons and/or identify sections of the formation to be targeted for production. A number of techniques can be employed to facilitate production by locating and/or stimulating fractures in the formation. For example, stimulation procedures can be employed, such as hydraulic fracturing, to initiate or extend fractures that provide a flow path between a reservoir and the borehole. Knowledge of the location of natural or induced fractures can greatly enhance the effectiveness of drilling and stimulation.

SUMMARY

An embodiment of an apparatus for estimating properties of an earth formation includes a carrier configured to be deployed in a borehole in the earth formation, the carrier connected to a drilling assembly configured to perform a drilling operation that includes including injection of fluid into a borehole, and a sensor assembly configured to measure at least one return flow parameter of a return fluid at a surface location, the return fluid returning to the surface location from the borehole. The apparatus also includes a processor configured to perform receiving one or more return flow parameter values for a period of time after injection of fluid is stopped, analyzing the one or more return flow parameter values to identify a ballooning event, in response to identifying the ballooning event, estimating at least one of a location and a property of one or more fractures in the formation, and performing one or more aspects of at least one of the drilling operation and a subsequent operation based on at least one of the location and the property of one or more fractures.

An embodiment of a method of estimating properties of an earth formation includes deploying a carrier in a borehole in the earth formation, performing a drilling operation that includes injection of fluid into a borehole, and measuring at least one return flow parameter of a return fluid at a surface location for a period of time after injection of fluid is stopped, the return fluid returning to the surface location from the borehole. The method also includes receiving one or more return flow parameter values at a processor, and analyzing the one or more return flow parameter values to identify a ballooning event, in response to identifying the ballooning event, estimating at least one of a location and a property of one or more fractures in the formation, and performing one or more aspects of at least one of the drilling operation and a subsequent operation based on at least one of the location and the property of one or more fractures.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Methods, systems and apparatuses are provided for evaluating a formation during a drilling operation or other energy industry operation that includes circulating injection fluid in a borehole, or subsequent to the operation. An embodiment of a method includes measuring fluid flow from a borehole toward the surface (also referred to as flowout or return flow), and particularly measuring fluid flow after pumping or fluid injection is halted or suspended (also referred to as flowback), and characterizing properties of the formation based on flowback measurements. In one embodiment, the properties include whether natural or induced fractures are present in the region, and characteristics of the fractures such as size, length, surface area and aperture.

In one embodiment, the method includes analyzing the flowback measurements to identify one or more regions of the borehole at which ballooning has occurred. Ballooning refers to the loss of fluids (i.e., fluids pumped into a borehole during drilling) into the formation during drilling or injection, coupled with fluid flowing back into the borehole when pumping stops and the borehole pressure drops. Examples of analyzing return flow measurements include flowback fingerprinting, comparison of flowback parameters and comparison of mud pit (or other fluid source) volumes or levels to estimate and characterize the size and nature of the fractures. The method may be performed in real time during drilling and/or during subsequent analysis.

Embodiments described herein provide a number of advantages, including allowing stakeholders to quickly and effectively identify whether formation regions are conducive to stimulation or production, and providing formation characteristic information that can be used in planning subsequent production and/or stimulation operations. For example, identification and qualitative and/or quantitative assessment of ballooning provides additional certainty during drilling as to how and where to acidize or otherwise stimulate the formation, and provides an early indication of how productive the borehole may be. In addition, embodiments described herein facilitate understanding of fluid losses and kicks in order to reduce risk during drilling.

Embodiments described herein may be useful for a variety of drilling and production applications, and are applicable to various environments, including conventional gas and oil reservoirs, and unconventional formations such as heavy oil, shale gas, shale oil and tight gas formations, as well as geothermics.

Figure 1:
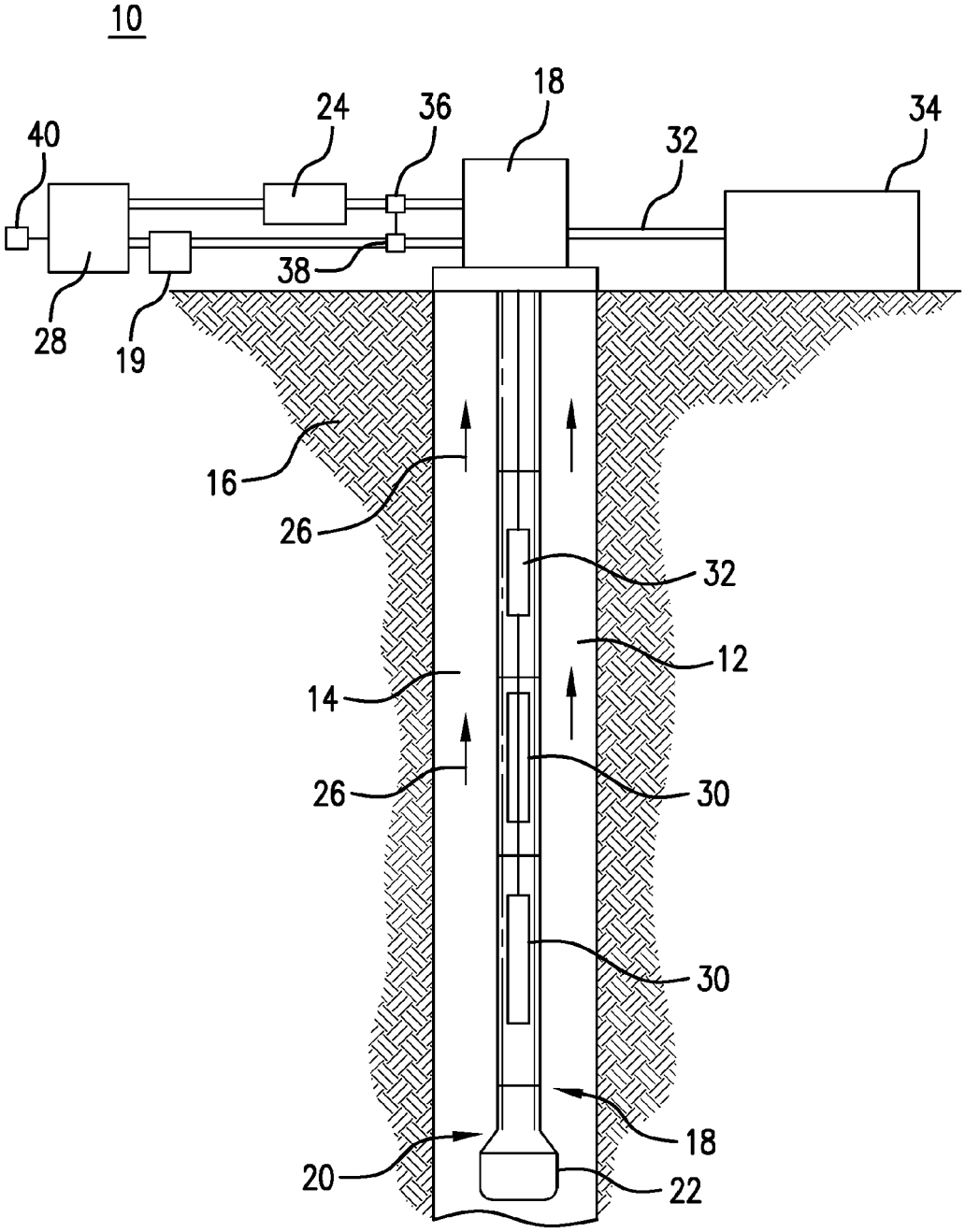
FIG. 1 depicts an embodiment of a drilling and/or measurement system.

Referring to FIG. 1, an embodiment of a well drilling, logging and/or production system 10 includes a borehole string 12 that is shown disposed in a well or borehole 14 that penetrates at least one earth formation 16 during a drilling or other downhole operation. As described herein, "borehole" or "wellbore" refers to a hole that makes up all or part of a drilled well. It is noted that the borehole 14 may include a vertical, deviated and/or horizontal, and may follow any suitable or desired path. As described herein, "formations" refer to the various features and materials that may be encountered in a subsurface environment and surround the borehole.

A borehole as described herein may refer to a single hole or multiple holes (e.g., branched holes). For example, the borehole may be a single hole extending from the surface or a hole extending as a branch of an existing well (sidetrack plus upper section of previous borehole). A branched borehole may have several connected sidetracks in a formation (e.g. for coiled tubing drilling). A surface structure or surface equipment 18 includes or is connected to various components such as a wellhead, derrick and/or rotary table for supporting the borehole string, rotating the borehole string and lowering string sections or other downhole components. In one embodiment, the borehole string 12 is a drill string including one or more drill pipe sections that extend downward into the borehole 14, and is connected to a drilling assembly 20 that includes a drill bit 22. The surface equipment 18 also includes pumps, fluid sources and other components to circulate drilling fluid through the drilling assembly 20 and the borehole 14, and may include components to receive, process and evaluate fluid, such as shakers 19 (e.g., shale shakers), other fluid processing equipment and flow and mud property sensors. Although the drill string and the drill bit is shown in FIG. 1 as being rotated by a surface rotary device, the drill bit may be rotated by a downhole motor such as a mud motor.

For example, a pumping device 24 is located at the surface to circulate drilling mud 26 from a mud pit of other fluid source 28 into the borehole 14. Drilling mud 26 is pumped through a conduit such an interior bore of the borehole string 12 and exits the borehole string 12 at or near the drill bit 22. The drilling mud 26 then travels upward from the drill bit 22 through an annulus of the borehole 14 and returns to the surface. The returning borehole fluid includes drilling mud 26 and may include formation fluids that enter into the borehole 14 during the drilling process and/or rock cuttings produced by the drill bit 22 during drilling.

In one embodiment, the system 10 includes any number of downhole tools 30 for various processes including formation drilling, geosteering, and formation evaluation (FE) for measuring versus depth and/or time one or more physical quantities in or around a borehole. The tool 30 may be included in or embodied as a bottomhole assembly (BHA), drill string component or other suitable carrier. A "carrier" as described herein means any device, device component, combination of devices, media and/or member that may be used to convey, house, support or otherwise facilitate the use of another device, device component, combination of devices, media and/or member. Exemplary non-limiting carriers include drill strings of the coiled tubing type, of the jointed pipe type and any combination or portion thereof. Other carrier examples include casing pipes, wirelines, wireline sondes, slickline sondes, drop shots, downhole subs, bottom-hole assemblies, and drill strings.

The tool 30, the drilling assembly 20 and/or other portions of the borehole string 12 include sensor devices configured to measure various parameters of the formation and/or borehole. In one embodiment, the tool 30 is configured as a logging-while-drilling (LWD) tool configured to perform measurements such as temperature, pressure, flow rate, and others.

Although the system 10 is shown as including a drill string, it is not so limited and may have any configuration suitable for performing an energy industry operation that includes injecting or circulating fluid in the borehole 14. For example, the system 10 may be configured as a stimulation system, such as a hydraulic fracturing and/or acidizing system.

In one embodiment, the tool 30, drilling assembly 20 and/or sensor devices include and/or are configured to communicate with a processor to receive, measure and/or estimate characteristics of the downhole components, borehole and/or the formation. For example, the tool 30 is equipped with transmission equipment to communicate with a processor such as a downhole processor 32 or a surface processing unit 34. Such transmission equipment may take any desired form, and different transmission media and connections may be used. Examples of connections include wired, fiber optic, acoustic, wireless connections and mud pulse telemetry.

The processor may be configured to receive measurement data and/or process the data to generate formation parameter information. In one embodiment, the surface processing unit 34 is configured as a surface drilling control unit which controls various drilling parameters such as rotary speed, weight-on-bit, drilling fluid flow parameters and others.

In one embodiment, surface and/or downhole sensors or measurement devices are included in the system 10 for measuring and monitoring return fluid. For example, the surface processing unit 34 includes or is connected to a fluid measurement system that may perform measurements of fluid flowing into and out of the borehole 14 and/or the formation 16. The fluid measurement system includes various sensors for measuring fluid flow characteristics. In one embodiment, the fluid measurement system includes fluid pressure and/or flow rate sensors 36 and 38 for measuring fluid flow into and out of the borehole, respectively. For example, the sensor 38 is a flow out sensor for measuring the pressure and/or flow rate of returning fluid. The system may also include a fluid source sensor 40 connected to the fluid source 28 (e.g., a mud pit) for measuring the volume or level of fluid (e.g., drilling mud or stimulation fluid). Fluid flow characteristics may also be measured downhole, e.g., via fluid flow rate and/or pressure sensors in the tool(s) 30.

The fluid analysis system, the surface processing unit 34 and/or other components of the system 10 are configured to perform measurements and evaluations of a formation and/or drilling or other energy industry operation based on return fluid (e.g., return flow and/or flowback) measured during a drilling, stimulation or other operation. Return fluid may include fluid circulated into the borehole, such as drilling fluid (e.g., mud) and injection fluid, and may also include formation fluid that enters the borehole. It is noted that the measurements may include flowback and other measurements, e.g., a full set of surface measurements including flowback measurements.

"Flowback" refers to fluid flowing from a borehole, which is allowed to flow to the surface when fluid injection is stopped. Flowback is the finite amount of fluid coming out of the annulus after pumps have stopped (i.e. cumulative flow out after stop of flow in). This is due to inertia and compressibility of the fluid column, and sometimes due to ballooning as well. Fluid injection is performed, e.g., during drilling (as drilling mud), during production or during a stimulation (e.g., acidizing or fracturing). Flowback is allowed to occur in a number of operations. For example, flowback occurs every time that pumping is halted or suspended, e.g., when a connection is made during a drilling operation. Flowback can also occur following a treatment (e.g., acidizing or hydraulic fracturing) or phase of a treatment, either in preparation for a subsequent phase of treatment or in preparation for cleanup and returning the borehole to production.

During normal return flow, injected fluid or fluid pumped into a borehole (e.g., drilling fluid) drains back to the fluid source once the pumping device is shut off. However, when the hydrostatic pressure exerted on the formation by the drilling fluid column is insufficient to hold the formation fluid in the formation, the formation fluid can flow into the borehole. This influx of formation fluid into the wellbore is known as a kick, and is generally undesirable. Flowback and/or return flow measurements can be used to detect whether a kick is occurring or will occur.

Properties or parameters of the return fluid, i.e., return flow and/or flowback parameters, are measured by sensing devices such as the flow out sensor 38 and/or the fluid source sensor 40 and the resulting measurement data is collected and analyzed by the processor. Return fluid parameters may be any property or parameter of return fluid, such as flow rate, pressure, flow volume, fluid constituents and others. In one embodiment, the return fluid parameters are analyzed to identify and/or characterize regions of a formation that include natural and/or induced fractures.

Return fluid parameters may be used to evaluate the formation or a current operation, and may be used to plan future operations or adjust operational parameters of a current operation. For example, flowback parameters are used to estimate properties of fractures induced or extended during drilling or stimulation, such as surface area, aperture and closure. The return flow and/or flowback properties may be estimated using surface measurements or a combination of surface and downhole measurements. The systems and methods described herein can be incorporated into existing systems and techniques, such as kick detection systems, and provide benefits such as increased certainty during drilling regarding how and where to stimulate (e.g., acidize, inject fracturing fluid), and early indications of how productive a borehole (or production zone) may be.

In one embodiment, the flowback parameters are analyzed to identify ballooning in the borehole and formation. "Ballooning" is the loss of injected fluids into the formation during a drilling or other injection operation, with at least part of the fluid flowing back into the borehole once the pressure drops. Ballooning may be induced by the planned or unplanned creation of temporary fractures during drilling. Ballooning exhibits a number of characteristics that are distinguishable from a kick. During the fracture closing period of ballooning after shutting down the pumps, the rate of flowback volume increase exceeds that of the rate when there is no ballooning, and the difference in flowback rate between otherwise equal ballooning and non-ballooning flowbacks decreases over time and falls to approximately zero (i.e., the flowback volume levels off or becomes substantially constant) upon closure of the fracture or fractures that caused the ballooning. In contrast, during a kick, the flowback rate continues to increase as formation fluid enters the borehole. It is noted that, if the borehole includes branched or sidetracked holes, the ballooning of the other connected to a current borehole segment may be cumulative to that of the current segment.

Flowback parameters may include any measured property of the fluid and/or the operation that provides an indication of flowback behavior. Examples of flowback parameters include flow rate, pressure, flowback volume, fluid source (e.g., mud pit) volume, and rates of change thereof. Values of one or more flowback parameters are received and analyzed by the processor to identify ballooning and estimate one or more properties of the formation and/or fractures in the formation.

The processor may analyze flowback parameter values and identify a ballooning event, estimate characteristics of the ballooning event and/or estimate formation properties based on the values and/or a pattern of values. In one embodiment, ballooning is identified and/or characterized by comparing the flowback parameter values to a threshold, where a value meeting or exceeding the threshold (or meeting or exceeding the threshold for a time period within a selected range) indicates a ballooning event. The threshold may be selected as a specific value, or based on analysis of flowback parameters as a function of time and/or depth. For example, the threshold is based on a mean or average (e.g., a running average) of measured flowback parameter values.

In one embodiment, an identifiable pattern or fingerprint may be determined from the flowback parameter values and compared to pre-selected patterns indicative of ballooning. Such a pattern or fingerprint may include a slope, duration, shape of a curve derived from the values, magnitude of a value or peak in the parameter values or any other pattern. The fingerprint may be derived using curve fitting, regression or any other suitable statistical analysis.

Figure 2:
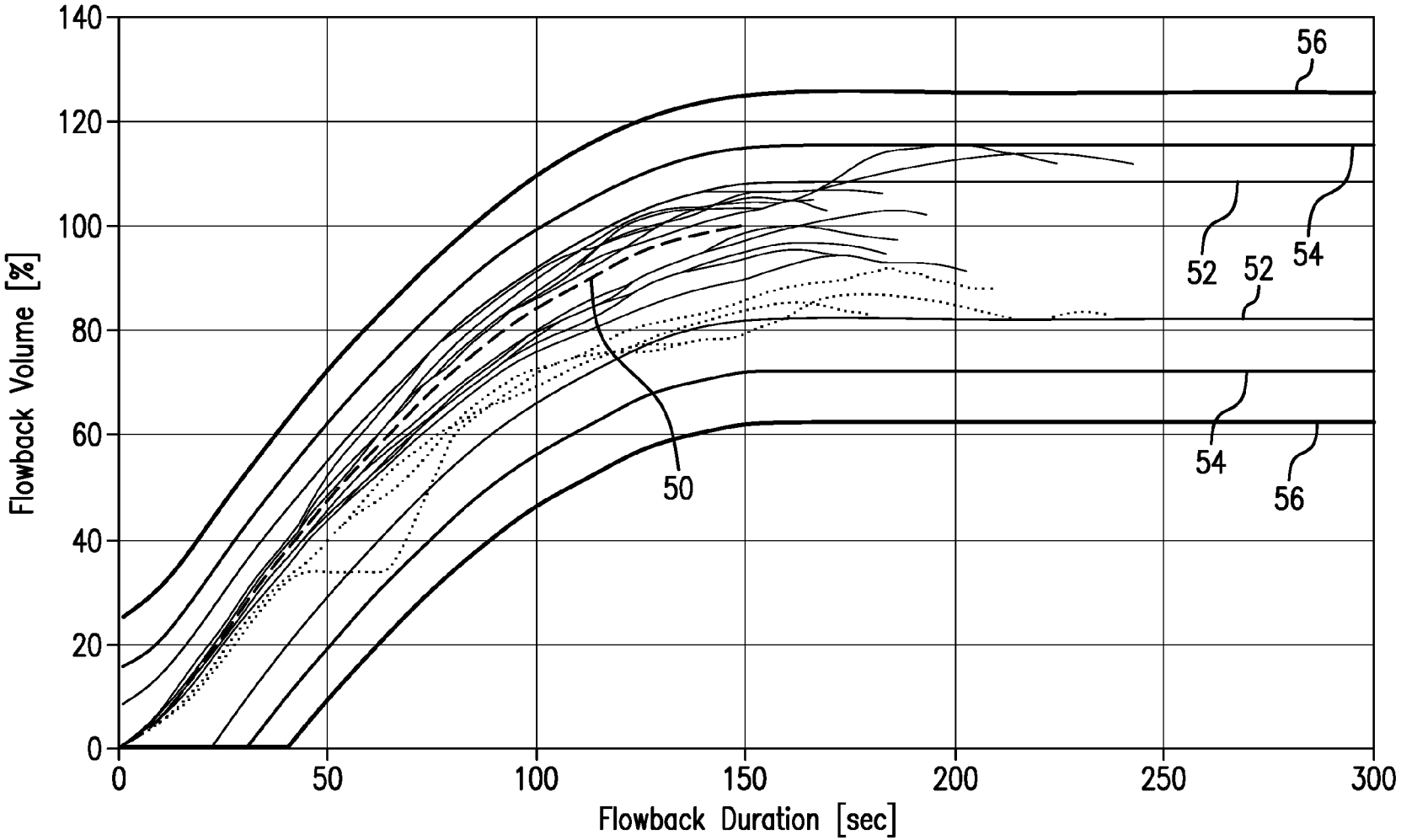
FIG. 2 depicts an example of fluid flow measurement curves representing flowback out of a borehole after pumping has stopped.
Figure 3:
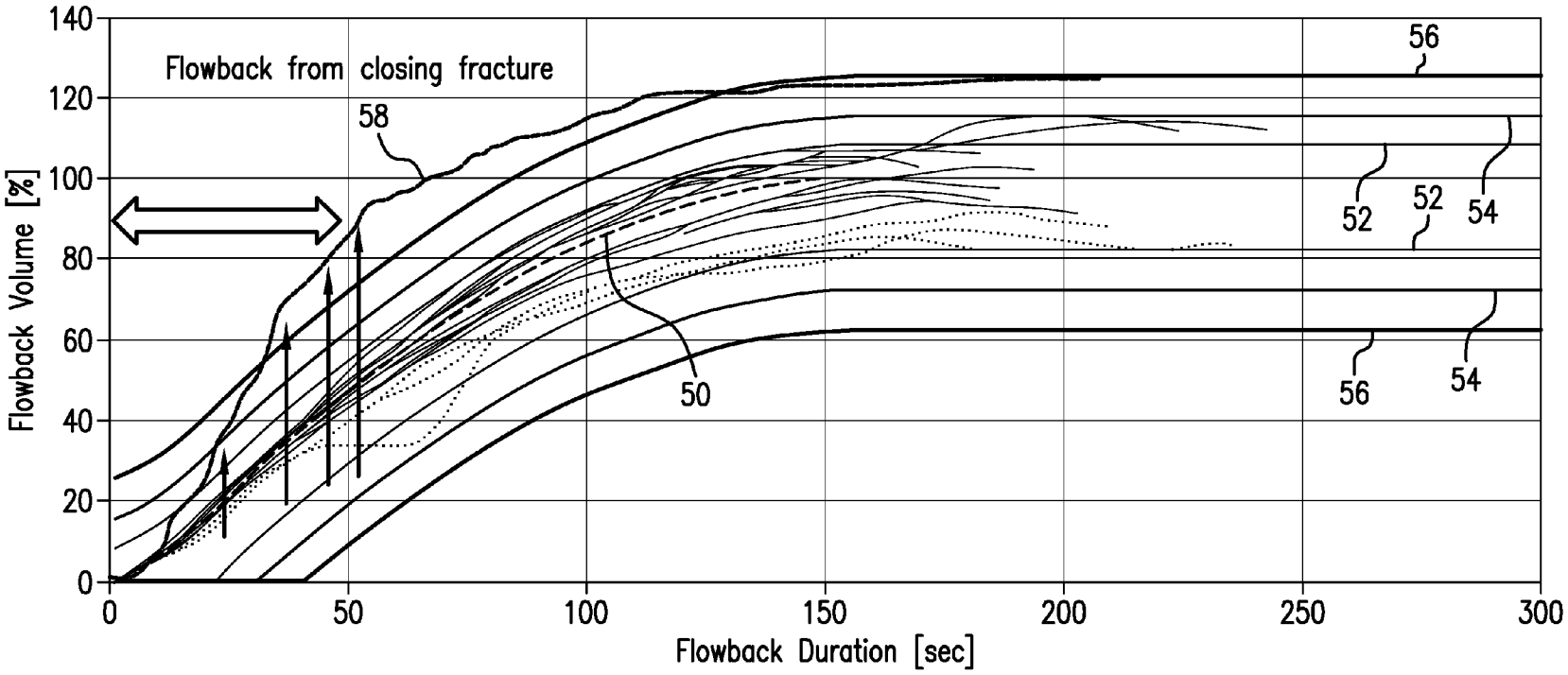
FIG. 3 depicts an example of fluid flow measurement curves resulting from ballooning of a formation during drilling.
Figure 4:
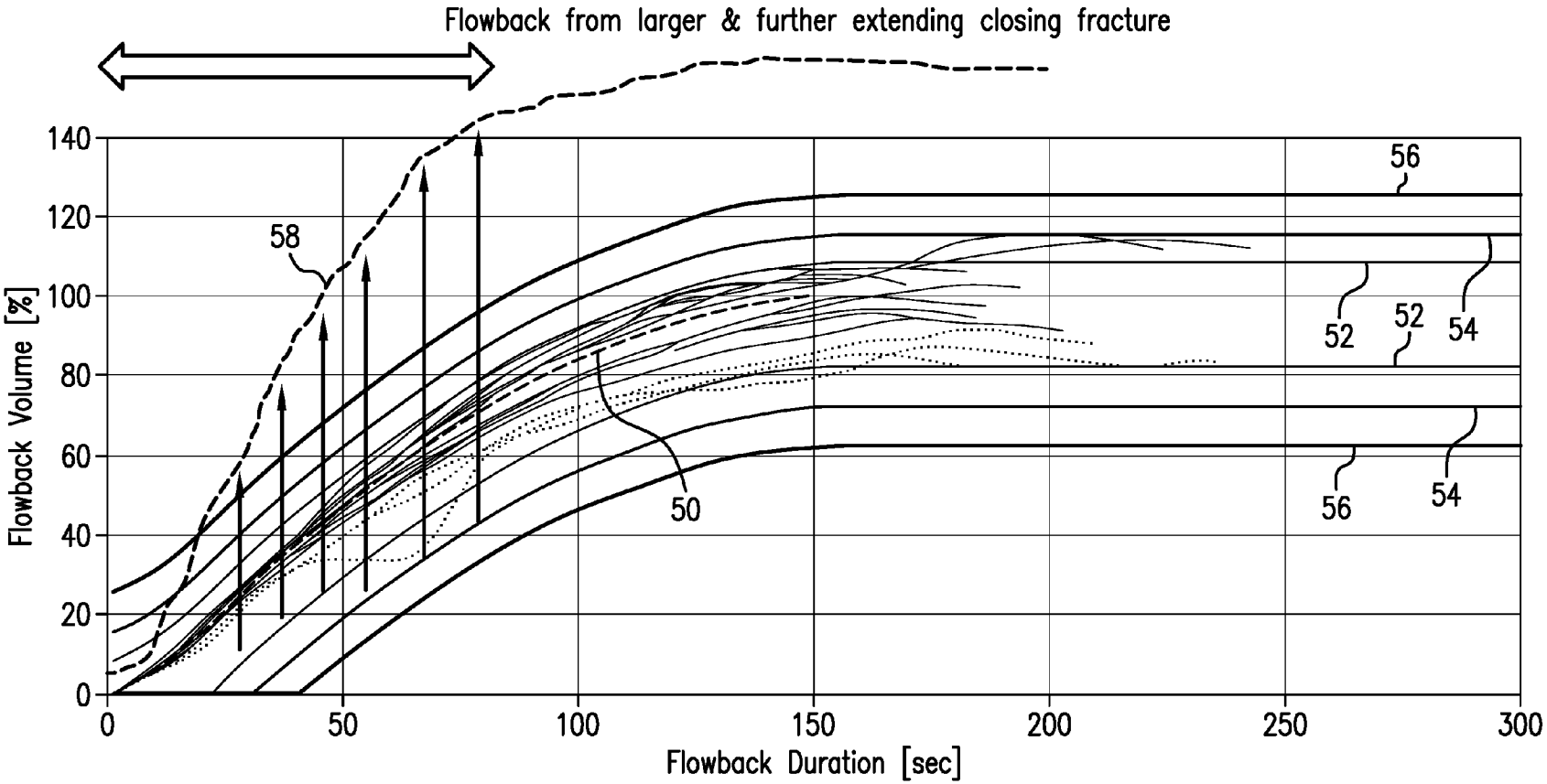
FIG. 4 depicts another example of fluid flow measurement curves resulting from ballooning of a formation during drilling.

FIGS. 2-4 illustrate examples of flowback measurements and aspects of ballooning. In each of these examples, the flowback volume is presented as a function of flowback duration, which is an amount of time immediately following shutdown of a pump or otherwise after injection of fluid is stopped or suspended. The flowback volume is the total volume of fluid that has returned to the surface at a given time. This can be measured by measuring changes in volume in a mud pit or other fluid source container, or calculated by measuring fluid flow rates in the borehole or return line.

FIG. 2 shows an example of flowback in an instance where there is no significant ballooning. The flowback volume is shown by a flowback curve 50. The flowback curve is derived from flowback volume measured at a plurality of time points or time intervals. For example, each time interval is associated with a sampling time.

In this example, the fluid flowback volume increases and then stabilizes or levels off, i.e., becomes constant or substantially constant or stays within selected limits. The flowback may be measured as part of a kick detection or monitoring scheme, in which the flowback is compared to selected limits or ranges. In this example, limit curves are provided to establish safe flowback ranges, and facilitate identification of a kick. A first set of limit curves 52 establishes a first range, a second set of limit curves 54 establishes a second range and a third set of limit curves 56 establishes a third range. Each of these ranges can be associated with different levels of danger and be used to provide appropriate warning or alarm levels. Flowback volume values occurring outside the envelope established by one or more of the sets of limit curves may indicate ballooning or a kick.

FIGS. 3 and 4 show examples of a flowback curve that is indicative of ballooning. The flowback curve 58 shape or pattern shows that the rate at which flowback volume increases exceeds that of the expected flowback curve 50 for a duration and then levels off. This behavior may be due to a fracture being induced or opened as a result of the drilling and/or injection, which causes injected fluid to flow into the formation. As the fracture closes after injection is stopped, the fluid is forced back into the borehole.

In addition to identifying whether a ballooning event occurred, the flowback curve 58 may be used to estimate properties of a fracture. For example, the flowback measurement curve 58 of FIG. 4 shows the flowback from a fracture that is larger and/or extends further from the borehole than the fracture that induces the flowback of FIG. 3. The magnitude of the curve (i.e., the highest value or values in the curve), the slope of the curve, the amount of time during which flowback volume is increasing, and other properties of the flowback curve 58 may be correlated with properties such as size and length of the fracture, fractures, or fracture network.

A ballooning event can be distinguished from a kick based on the duration of the flowback (e.g., the time between onset of flowback and levelling off). If a kick occurs, the duration of the flowback is significantly longer and does not level off, because formation fluid enters the borehole and the flowback volume continues to increase.

Ballooning can be characterized based on various types of analyses of the flowback. For example, the difference between flowback volume at a given time point relative to the expected volume can be indicative of a fracture. A minimum threshold for the difference can be set as indicative of a fracture, and the magnitude of the difference can be associated with fractures having different sizes (e.g., opening size, length). Similarly the rate of flowback increase (i.e., the slope of the curve 58) can be associated with the existence, location, and/or properties of the fracture.

It is noted that reference to a fracture is not intended to limit the embodiments to a single fracture. Accordingly, a "fracture" may denote a single fracture or multiple fractures forming part of a fracture network.

Figure 5:
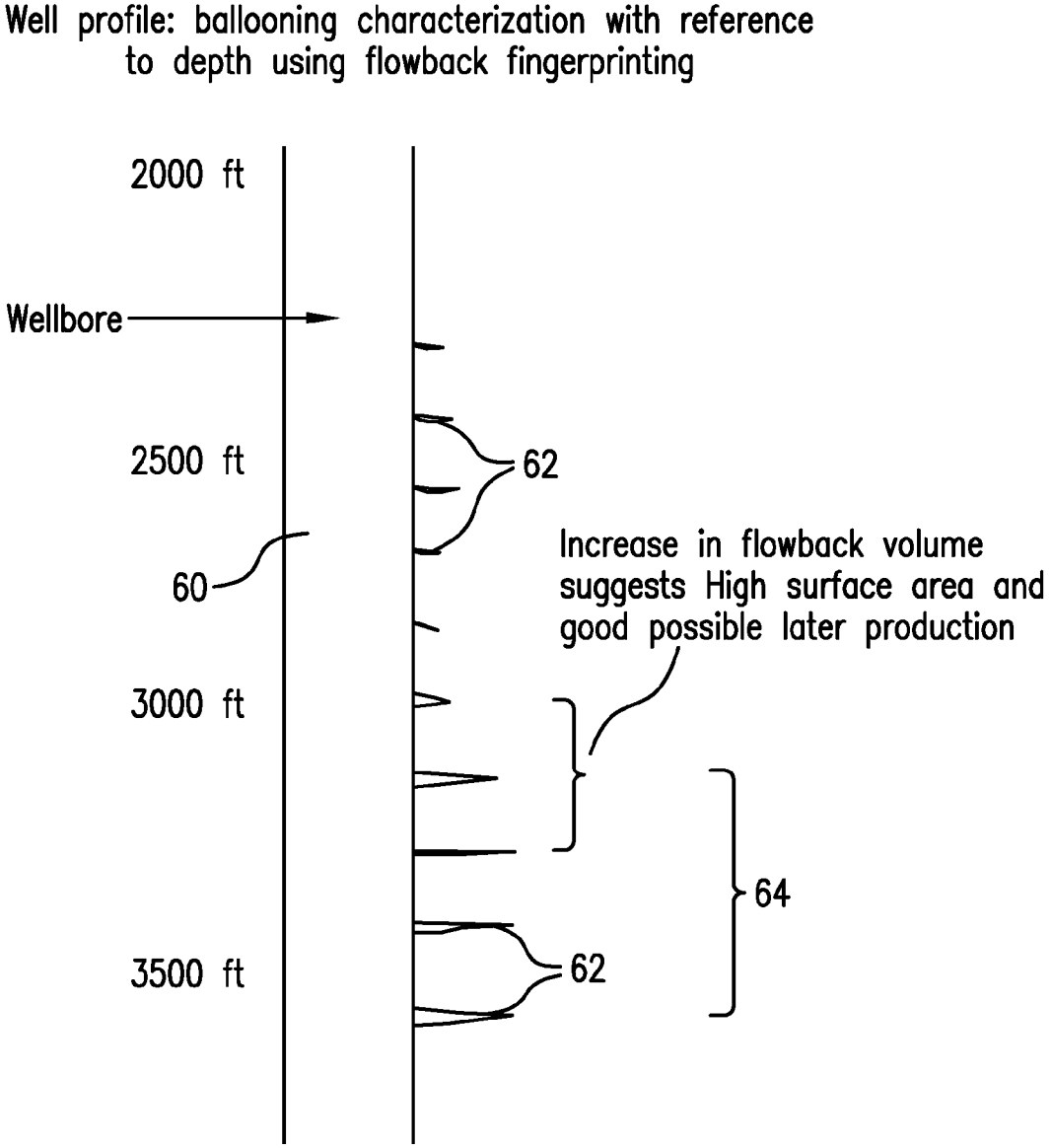
FIG. 5 depicts an example of a wellbore that includes depictions of flowback measurements at various depths along a borehole.
Figure 6:
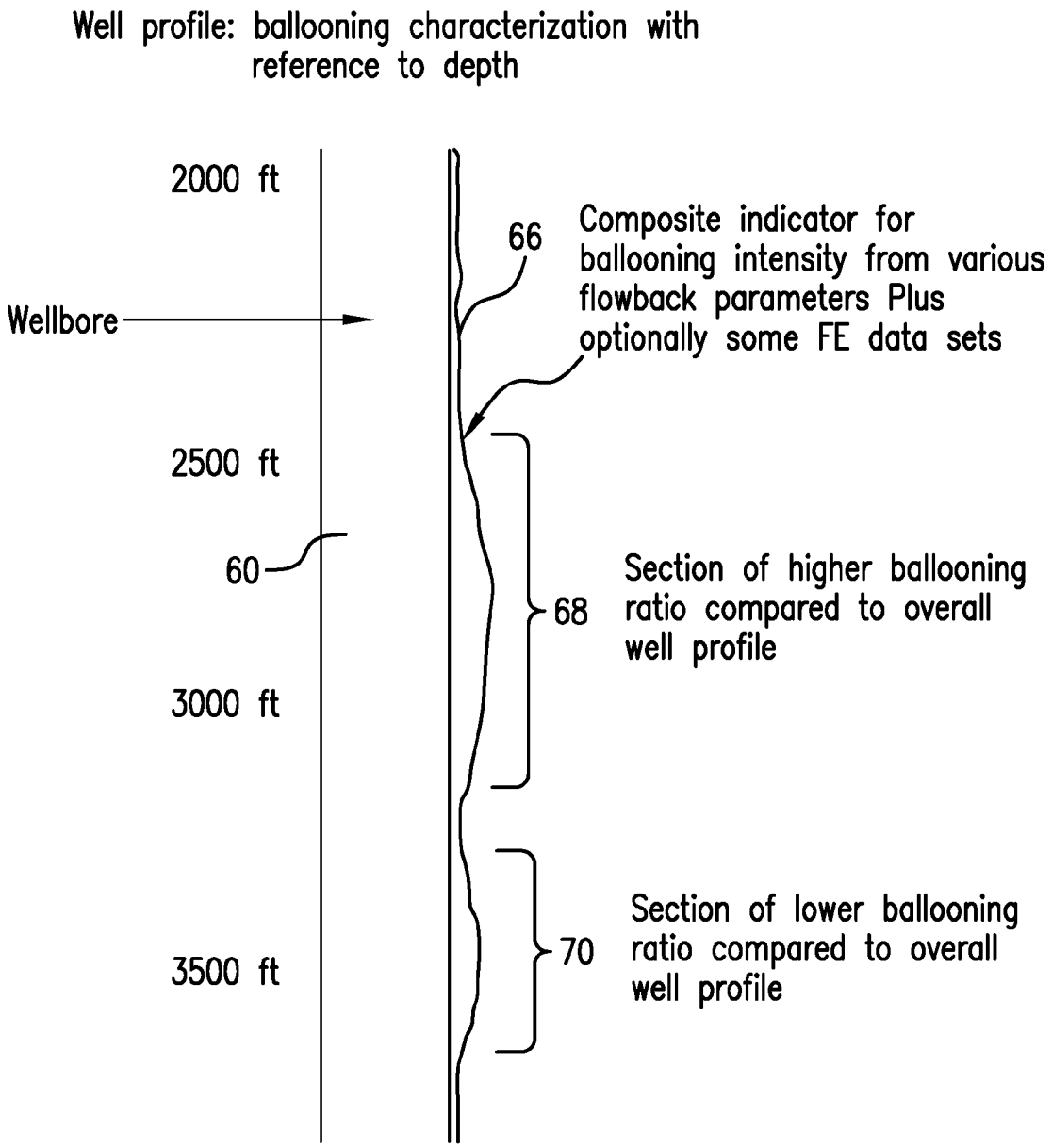
FIG. 6 depicts an example of a wellbore that includes a composite curve generated based on flowback measurements at various depths along a borehole.

FIGS. 5 and 6 show examples of flowback data plotted as a function of depth to facilitate identifying ballooning and determining the depth or location of ballooning and corresponding formation properties. In these examples, reference is made to depth, which may be vertical depth or a distance from the surface along the path of a borehole. In deviated or horizontal boreholes, the depth corresponds to the distance, which may not necessarily correspond to vertical depth.

FIG. 5 shows flowback data correlated to depth, which is used by the processor, in one embodiment, to identify ballooning, estimate a magnitude or intensity of ballooning, and/or estimate a location or interval of a borehole 60 associated with ballooning. Measurements of at least one flowback parameter, such as flowback volume, the difference between flow in and flow out, flowback flow rate and/or pressure, are performed for a time period or interval substantially beginning when pumping is turned off or injection of fluid is otherwise halted or suspended. During each interval, the flowback measurements are performed continuously or near continuously (i.e., at a selected sampling rate). In this example, as drilling progresses, the operation and fluid injection are periodically stopped for a time to connect a drill pipe segment or other string segment or component to the drill string. At each time period, the drill bit, drilling assembly, BHA or other component is located at a corresponding depth or depth interval.

The processor receives measurements of the flowback parameter during the time period and correlates each time period and its respective measurement data set with a depth or depth interval. A flowback curve 62 is generated for each depth interval. In this way, a value or magnitude of a flowback parameter or parameters is estimated for each depth interval. The flowback curve 62 at each depth interval is compared to adjacent curves and or other curves. These other curves may be derived from, for example, different runs in the same or other depth sections of the same well, from offset wells, and/or from modeling. For example, a magnitude value is calculated as the amplitude of a peak in each curve. Other values that can be calculated include an average or mean value or any value derived from any suitable statistical analysis.

The magnitude value may be compared to a reference corresponding to the magnitude value at one or more other depth intervals (one or more reference values). For example, the magnitude value at a given depth interval is compared to the magnitude value of one or more adjacent depth intervals. In another example, the magnitude values for a plurality of depth intervals are statistically analyzed or otherwise analyzed to produce an average value of the magnitudes.

A location or interval along the borehole is identified based on the comparison as being a location or interval of interest, e.g., as a location or interval conducive for stimulation or production. For example, the location or interval is identified as including induced or natural fractures, or at least having a fracture network that is larger than the fracture network of adjacent intervals. Such a location of interest can be identified as being conducive to production or stimulation.

In this example, an interval or section 64 of the borehole is identified as having favorable fracture properties and is identified as a candidate for subsequent stimulation and/or production. The identified interval 64 may be a single interval or encompass multiple intervals as shown in FIG. 5. In this example, the identified interval is associated with a difference between the flowback parameter in the identified interval and adjacent intervals that meets or exceeds a selected threshold.

Flowback evaluation may be based solely on one type of analysis, such as flowback fingerprinting using a single flowback parameter (e.g., volume or flow rate) or multiple parameters. Flowback measurements may be performed for a given location or interval by comparison with a single adjacent interval or multiple adjacent intervals (e.g., the adjacent intervals above and below an interval or group of intervals).

The flowback measurements may be analyzed to generate a composite parameter that includes flowback measurements and measurements of other properties and/or flowback measurements taken at other times and/or locations. For example, the flowback measurements are combined with formation evaluation data, such as readings of resistivity, density, porosity, or images thereof. In another example, the flowback measurements are combined with drilling parameter data, such as WOB and ROP.

In one embodiment, flowback parameters (and optionally additional types of measurement data) are analyzed to generate a composite parameter value or curve. An example of a composite curve 66 is shown in FIG. 6. The composite curve can be generated by a number of flowback parameters, such as a combination or weighted combination of flowback volume, flowback flow rate, changes in flowback volume/flow rate. The flowback parameters can also be combined with various formation evaluation or other measurements, such as resistivity, porosity, fluid composition and others.

In the example of FIG. 6, the composite curve represents values of a ballooning ratio at various depths. The ballooning ratio is a ratio of the amplitude or magnitude of a flowback parameter (or composite value) to a reference value. The reference value may be a pre-selected value (e.g., an expected flowback volume or flow rate) for a section of the borehole, or a value based on a statistical analysis of the flowback parameter. In this example, the reference value is a running average of the flowback parameter or an average of a given section. The magnitude of the flowback parameter or the ratio is associated with the size and/or extent of a fracture or fractures. In the example of FIG. 6, sections 68 and 70 are identified as having relatively high ballooning ratios. The section 68 is identified as having a higher ballooning ratio and a greater width or extent of fractures than the section 70.

Figure 7:
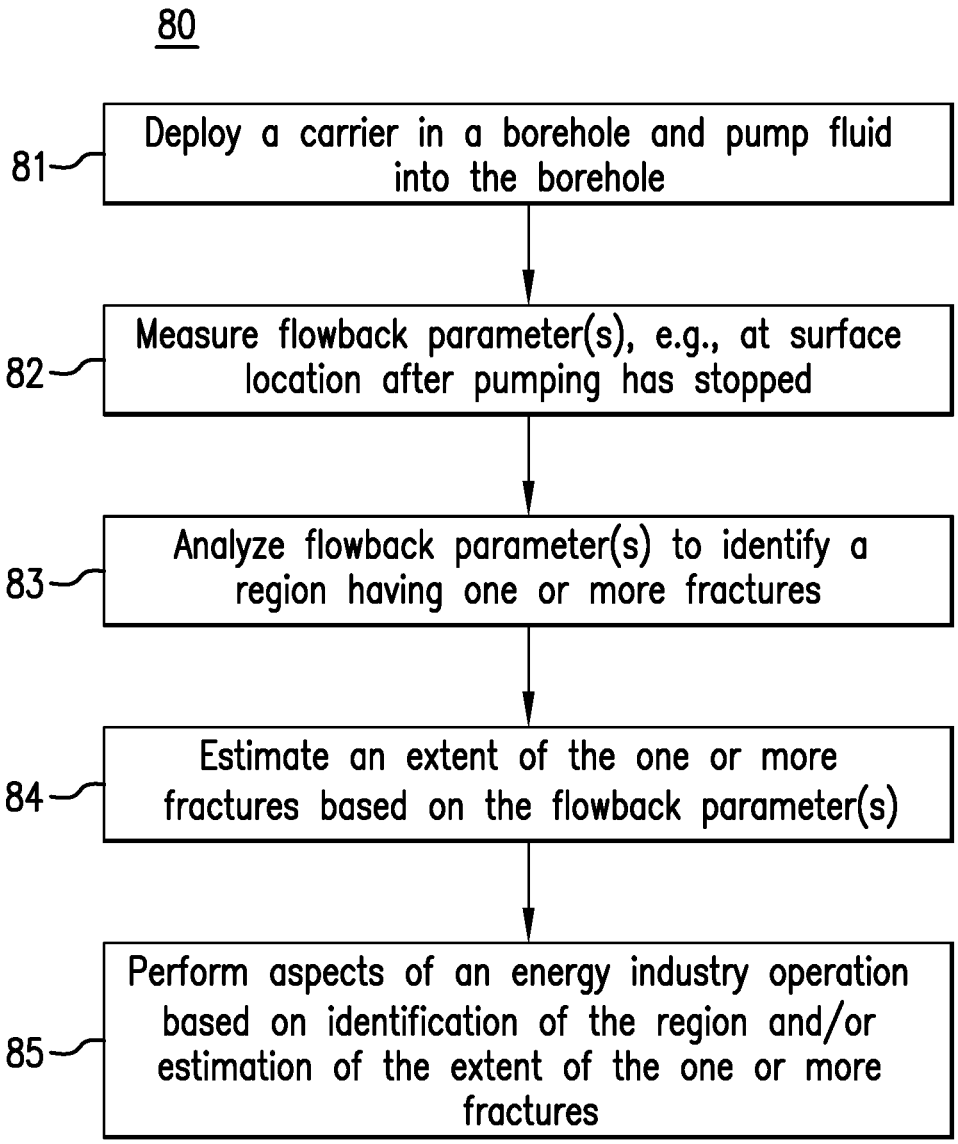
FIG. 7 is a flow chart that depicts an embodiment of a method of estimating formation properties based on flowback measurements.

FIG. 7 illustrates a method 80 of performing flowback measurements and estimating properties of a formation. The method 80 may be performed in conjunction with the system 10, but is not limited thereto. The method 80 includes one or more of stages 81-85 described herein, at least portions of which may be performed by a processor, such as the surface processing unit 34 or a processor included in a pre-existing kick detection system (KDS). In one embodiment, the method 80 includes the execution of all of stages 81-85 in the order described. However, certain stages 81-85 may be omitted, stages may be added, or the order of the stages changed.

In the first stage 81, a drill string, production string or other carrier is deployed into a borehole. Drilling is performed by rotating a drill bit and circulating drilling fluid (e.g., drilling mud) into the borehole. For example, drilling fluid is pumped into a borehole from a mud pit or other fluid source via, e.g., the pumping device 24.

As described herein, "drilling" refer to any operation that creates a borehole, extends an existing borehole, or otherwise modifies a borehole (e.g., increases borehole size). Drilling can include normal "on bottom, making hole" drilling, but can also include other operations that involve circulating fluid downhole. Examples of operations that are considered drilling operations include wiper trips and reaming. Such drilling operations may include the use of a drilling-like downhole component (e.g., BHA), such as a drilling assembly, a measurement while drilling (MWD) component, a logging while drilling (LWD) component, a measurement after drilling (MAD) component, a milling component, and a component or assembly for reaming a hole or opening it up to a larger hole size. Although the method is described as being in conjunction with a drilling operation, the method may be used with other types of operations such as running screens, open hole packers, and other completions-related operations.

In the second stage 82, various parameters of fluid flow are measured during the drilling. The parameters include one or more flowback parameters, such as flow rate, return fluid pressure, mud pit (or other fluid source) volume, and combinations thereof. In one embodiment, the flowback parameters are measured from a surface location using flow sensors at a return line, sensors for measuring fluid volume in the mud pit and/or any other suitable device or system. The flowback parameters may include relative measurements, such as the rate of change of the flowback flow rate and/or mud pit volume.

In one embodiment, the time or time interval at which each measurement or set of measurements is taken is correlated to a depth value or depth interval. For example, when the pump is shut off during drilling to add a connection, the depth of the drill bit, BHA or other component is estimated and this depth is associated with the measurement or set of measurements. The flowback measurements may be displayed in any suitable manner or using any suitable data structure, such as a curve representing flowback measurements as a function of time or depth (e.g., as part of a drilling or measurement log). The curve may represent a single parameter or may be a composite curve calculated based on multiple parameters.

In the third stage 83, the flowback measurements are compared to a reference value or values, or a reference curve or pattern, to identify a region of the formation around the borehole that exhibits ballooning. If the ballooning is of sufficient magnitude and/or duration, the region may be identified as including a fracture or fracture network that can be subsequently exploited or utilized, e.g., for stimulation and/or production.

In one embodiment, the location or depth of the flowback measurements are estimated by comparing the temporal position relative to other flowback measurements. For example, as each connection in a drill string is made, flowback measurements may be performed and the depth of the drilling assembly is estimated. If this analysis is done for various subsequent flowbacks, information can be obtained about the width of the fracture opening, and the incremental growth from connection to connection, which can be later used to extend the fracture further in later stimulation.

In the fourth stage 84, the flowback measurements for the identified region are further analyzed to estimate various properties of the fracture and/or fracture network. In one embodiment, the magnitude of a flowback parameter in the identified region is associated with an extent or other property of the fracture or fracture network. Fracture properties include, for example, the width and length or distance that the fracture extends from the borehole.

In addition to fracture properties, the flowback measurements can be used to estimate other properties of the formation. For example, the permanent loss of mud in a region of the formation next to or near the ballooning region can be quantified, giving information about permeability of the formation and surface area vs surface volume.

In addition to characterizing the fracture or fracture network, the flowback measurements may be used to monitor the growth or other change in the fractures. For example, changes in flowback measurements from connection to connection may indicate the growth of a fracture.

It is noted that stage 84 may be performed subsequent to the identification in stage 83, or stages 83 and 84 may be performed simultaneously or as part of a single method stage.

Figure 8:
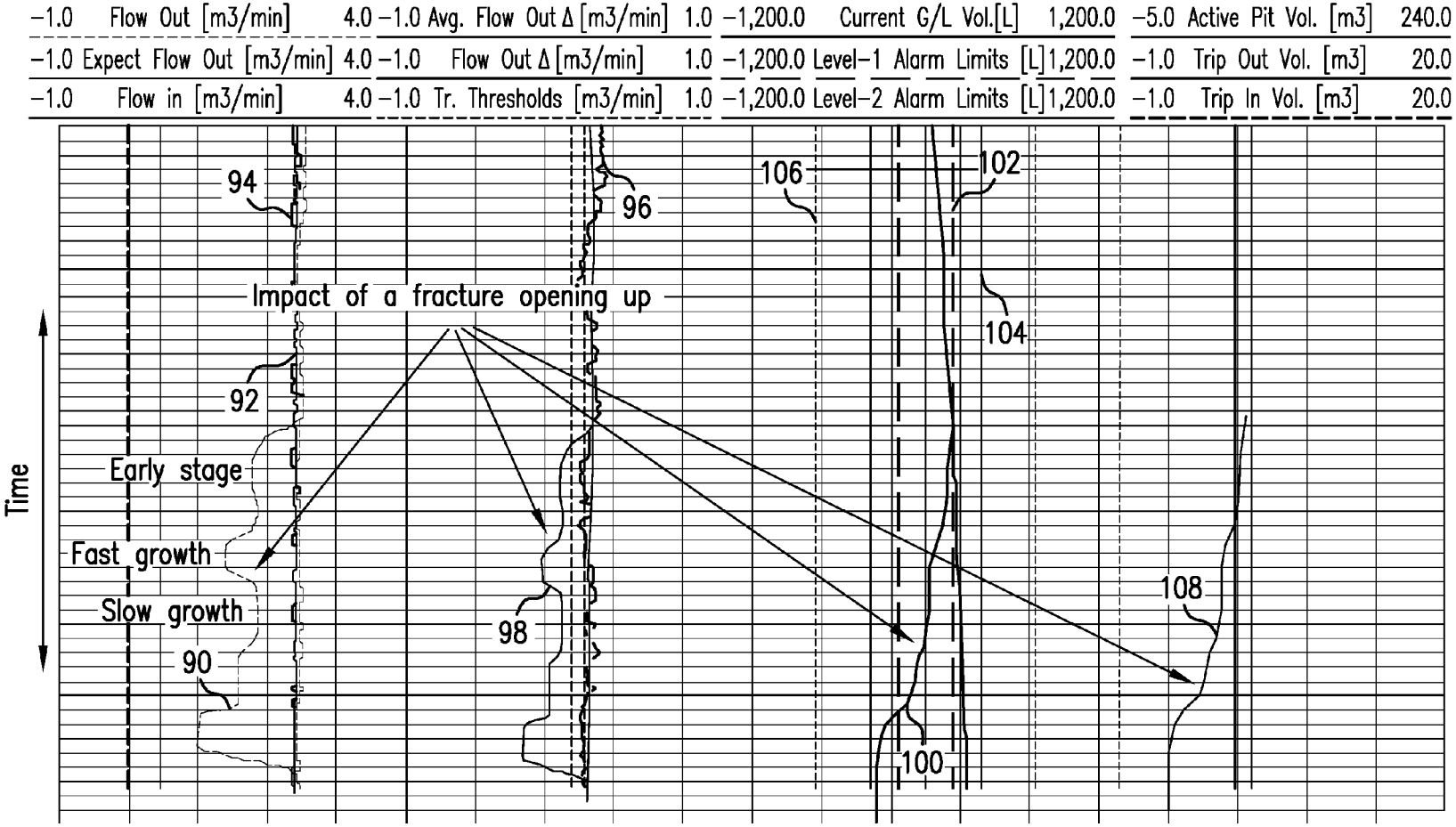
FIG. 8 depicts examples of logging curves representing fluid flowout or return flow characteristics.
Figure 9A:
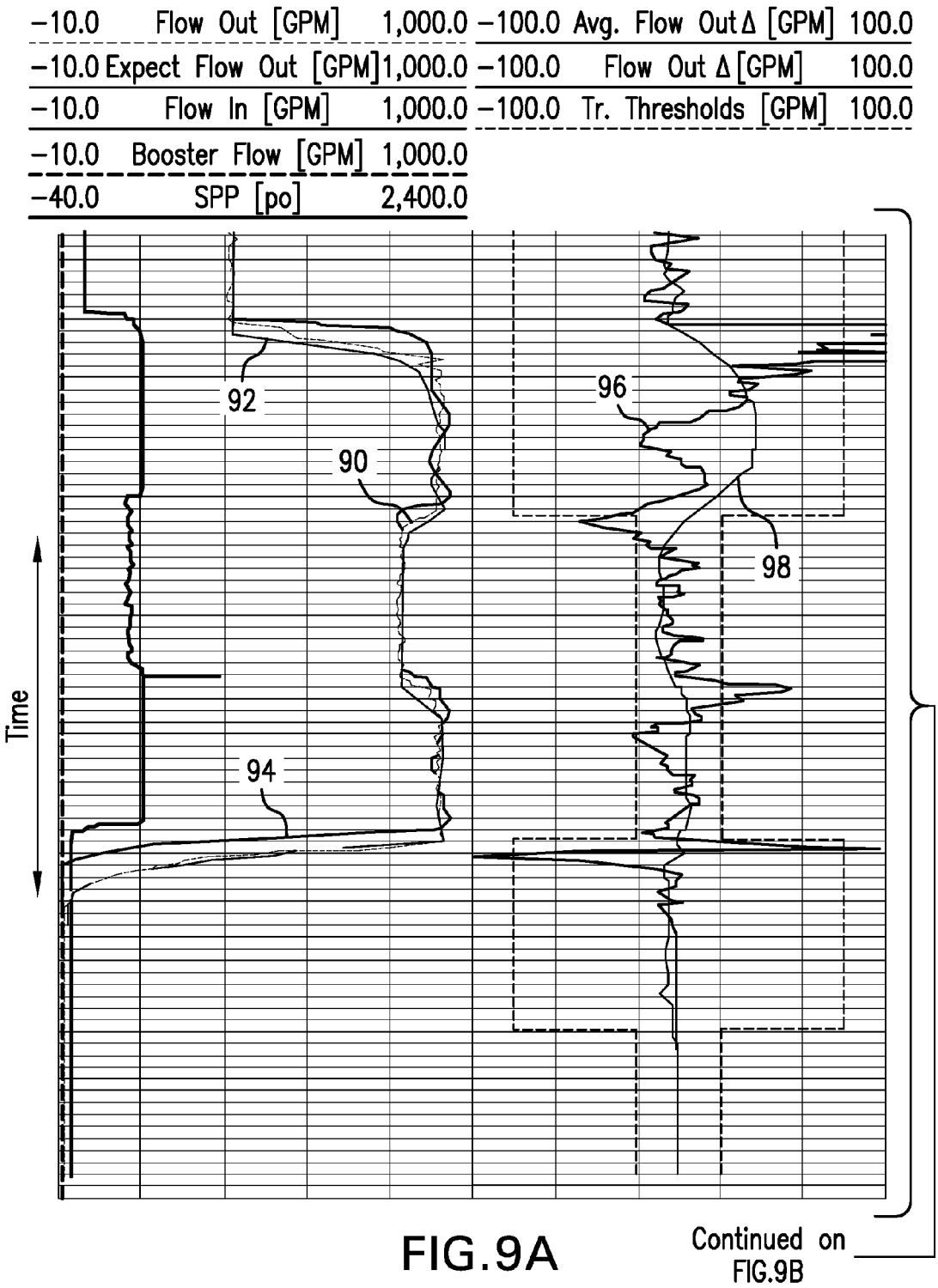
FIG. 9 depicts examples of logging curves representing fluid flowback characteristics indicative of ballooning.
Figure 9B:
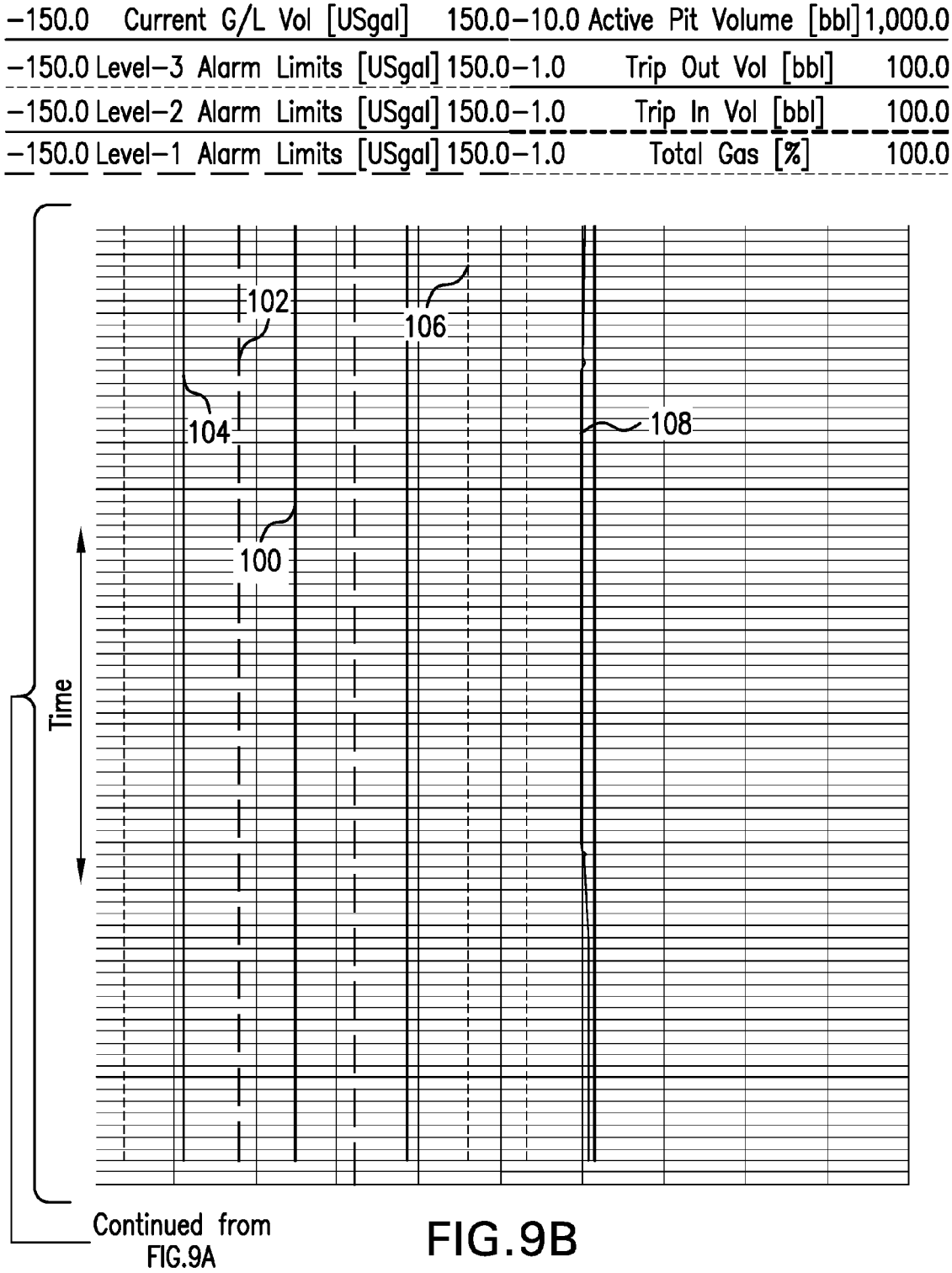

An example of the identification and/or characterization stages is shown in FIGS. 8 and 9, which illustrate various flowback parameter measurements performed during a selected time period after drilling is stopped, e.g., to add a connection. In these examples, the flow out rate was measured and plotted as a flow out rate curve 90 displayed with an expected flow out curve 92 and a flow in curve 94 from measurements of fluid flow in rates. The expected flow out curve may be derived from flow out measurement data from another borehole (e.g., an offset) in the same or a similar formation, or based on other information such as formation lithology data.

The change in flow out (flow out Δ), i.e., the difference between measured flow out and expected flow out, is shown as a curve 96 and a running average of the change in flow out is shown as a curve 98. Curve 100 shows the current total flow out volume measured during the time period, and is displayed with alarm limits 102, 104 and 106 representing alarm levels of increasing severity. Lastly, the active mud pit volume is shown as curve 108.

FIG. 8 shows an example where the formation region includes one or more fractures that are induced or extended by the drilling operation. As drilling mud is circulated in the borehole, some of the drilling mud flows into the fractures, reducing the rate of return fluid flow.

FIG. 9 shows an example of flowback measurements performed as part of a drilling operation during a time interval after pumping has stopped. The cessation of pumping is reflected in the drop in the flow in curve 94. The flow out curve 90 also drops with the decrease in return fluid after pumping has stopped.

Flowback measurements such as those shown in FIGS. 8 and 9 may be used to evaluate production and performance properties. For example, before the shutdown of pumping, flow in and flow out are compared. The difference or delta (curve 94) and/or a time average of the delta (curve 96) may be being compared to dynamically defined thresholds (dashed black lines). For example, when curve 96 surpasses a threshold (e.g., if there is more than a little difference between what goes in the hole and what comes out), this rate is used and accumulated to a gain or loss volume.

The continuous losses or gains over a certain time period and/or hole depth range may be used to improve or generate the prediction of the extent and nature of the ballooning. The parameters of interest for this evaluation include one or more of the absolute value of the averaged delta (curve 96), the absolute value of the raw delta (curve 94), the rate of change of the averaged and/or raw delta, and the absolute value and time to accumulate to a maximum. These are additional methods to characterize ballooning: additional to the curve shape and extent of the finite flowback described in conjunction with FIGS. 2-4.

All or a subset of these evaluation criteria can be combined into a composite ballooning parameter, e.g., as described in conjunction with FIG. 6. The evaluation can also be multidimensional, e.g., one composite parameter describing volume, another describing extent of fracture, and/or another describing average width or width distribution.

In the fifth stage 85, aspects of an energy industry operation are performed based on estimations of formation properties. Energy industry operations include various processes and operations related to extracting or developing energy sources, such as drilling, stimulation, formation evaluation, measurement and/or production operations. Examples of energy industry operations include oil and gas drilling and geothermal drilling.

Geothermal drilling benefits may include evaluating/enhancing huff and puff operations, evaluating current and future fracture lengths towards the other well of a geothermal duplet, or just generally adjusting the model for heat transfer between borehole and formation. Other drilling operations such as traditional drilling, unconventional formation drilling, tunnel boring, pilot holes in mining can also be evaluated and/or adjusted using the embodiments described herein.

For example, the flowback measurements are used to plan a drilling operation (e.g., trajectory, bit and equipment type, mud composition, rate of penetration, etc.) and may also be used to monitor the operation in real time and adjust operational parameters (e.g., bit rotational speed, fluid flow). Other examples of actions that can be performed using the above estimations include changing aspects or parameters of equivalent circulating density (ECD) management functions, changing completions, etc.

Flowback detection and characterization can be used in managed pressure drilling (MPD), which employs mud injection to maintain an annular pressure in the borehole sufficient to prevent influx of formation fluid. For example, characterization of ballooning can be used to detect temporary fractures that occur during MPD. Backpressure in the borehole annulus can be increased to further open or extend such fractures to facilitate later stimulation (e.g., hydraulic fracturing or acidizing).

Flowback detection and characterization can also be used to identify optimized proppant size distribution and amount needed for stress cage treatment (e.g., by identifying fracture width). Embodiments described herein can be used to estimate future mud losses across the surface of the ballooning, to allow provisions to be made for such losses.

The method may complete by generating output information such as a recommendation during drilling, e.g., weight up drilling mud, change flowrate or other parameters effecting ECD with the goal of optimizing for production later.

Performing aspects of an energy industry operation may include evaluating parameters of the drilling operation during drilling, such as the size and type of materials circulated into the borehole, evaluating productive zones in the formation during drilling, and monitoring borehole integrity during drilling. For example, ballooning information and evaluation may be used to understanding lost circulation materials (LCM) size/type needs, perform formation integrity testing, performing or enhancing kick detection enhancement, determining the location and extent of productive zones, evaluating whether completing a well is desirable, or evaluating the applicability of wellbore strengthening methods such as stress cages.

Embodiment 1

An apparatus for estimating properties of an earth formation, the apparatus comprising: a carrier configured to be deployed in a borehole in the earth formation, the carrier connected to a drilling assembly configured to perform a drilling operation that includes including injection of fluid into a borehole; a sensor assembly configured to measure at least one return flow parameter of a return fluid at a surface location, the return fluid returning to the surface location from the borehole; and a processor configured to perform: receiving one or more return flow parameter values for a period of time after injection of fluid is stopped; analyzing the one or more return flow parameter values to identify a ballooning event; in response to identifying the ballooning event, estimating at least one of a location and a property of one or more fractures in the formation; and performing one or more aspects of at least one of the drilling operation and a subsequent operation based on at least one of the location and the property of one or more fractures.

Embodiment 2

The apparatus of any prior embodiment, wherein the at least one return flow parameter includes at least one of flow rate, return flow volume and volume of fluid in a fluid source.

Embodiment 3

The apparatus of any prior embodiment, wherein the processor is configured to compare a magnitude of the one or more return flow parameter values to a selected threshold, identify the ballooning event based on the magnitude being equal to or greater than the selected threshold, and estimating at least one of a size and an extent of the one or more fractures based on the magnitude of the one or more return flow parameters.

Embodiment 4

The apparatus of any prior embodiment, wherein analyzing includes determining a pattern of the one or more return flow parameter values, and comparing the pattern to a selected pattern associated with the ballooning event.

Embodiment 5

The apparatus of any prior embodiment, wherein performing the one or more aspects includes evaluating parameters of the drilling operation during drilling, the parameters including at least one of the size and type of materials circulated into the borehole, evaluating productive zones in the formation during drilling, and monitoring borehole integrity during drilling.

Embodiment 6

The apparatus of any prior embodiment, wherein performing the one or more aspects includes at least one of monitoring and adjusting managed pressure drilling (MPD) parameters during the drilling operation.

Embodiment 7

The apparatus of any prior embodiment, wherein the processor is configured to receive one or more return flow parameter values for each of a plurality of periods of time and estimate a return flow parameter magnitude for each period of time, each period of time associated with a different borehole depth interval, and analyzing includes comparing a magnitude of the one or more return flow parameter values for the period of time to the return flow parameter magnitude associated with one or more other periods of time.

Embodiment 8

The apparatus of any prior embodiment, wherein analyzing includes estimating a ratio of the magnitude of the one or more return flow parameter values to the return flow parameter magnitude, and identifying the ballooning event based on the ratio being equal to or greater than a selected threshold.

Embodiment 9

The apparatus of any prior embodiment, wherein analyzing includes estimating at least one of a size and an extent of the one or more fractures based on the ratio.

Embodiment 10

The apparatus of any prior embodiment, wherein analyzing includes generating a composite return flow parameter including a plurality of different return flow parameters, and identifying the ballooning event based on the composite return flow parameter.

Embodiment 11

A method of estimating properties of an earth formation, the method comprising: deploying a carrier in a borehole in the earth formation, and performing a drilling operation that includes injection of fluid into a borehole; measuring at least one return flow parameter of a return fluid at a surface location for a period of time after injection of fluid is stopped, the return fluid returning to the surface location from the borehole; receiving one or more return flow parameter values at a processor, and analyzing the one or more return flow parameter values to identify a ballooning event; in response to identifying the ballooning event, estimating at least one of a location and a property of one or more fractures in the formation; and performing one or more aspects of at least one of the drilling operation and a subsequent operation based on at least one of the location and the property of one or more fractures.

Embodiment 12

The method of any prior embodiment, wherein the at least one return flow parameter includes at least one of a flow rate, a return flow volume and a volume of fluid in a fluid source.

Embodiment 13

The method of any prior embodiment, wherein analyzing includes comparing a magnitude of the one or more return flow parameter values to a selected threshold, and identifying the ballooning event based on the magnitude being equal to or greater than the selected threshold.

Embodiment 14

The method of any prior embodiment, further comprising estimating at least one of a size and an extent of the one or more fractures based on the magnitude of the one or more return flow parameters.

Embodiment 15

The method of any prior embodiment, wherein analyzing includes determining a pattern of the one or more return flow parameter values, and comparing the pattern to a selected pattern associated with the ballooning event.

Embodiment 16

The method of any prior embodiment, wherein the processor is configured to receive one or more return flow parameter values for each of a plurality of periods of time, and analyzing includes estimating a return flow parameter magnitude for each period of time, each period of time associated with a different borehole depth interval.

Embodiment 17

The method of any prior embodiment, wherein analyzing includes comparing a magnitude of the one or more return flow parameter values for the period of time to the return flow parameter magnitude associated with one or more other periods of time.

Embodiment 18

The method of any prior embodiment, wherein analyzing includes estimating a ratio of the magnitude of the one or more return flow parameter values to the return flow parameter magnitude, and identifying the ballooning event based on the ratio being equal to or greater than a selected threshold.

Embodiment 19

The method of any prior embodiment, wherein analyzing includes estimating at least one of a size and an extent of the one or more fractures based on the ratio.

Embodiment 20

The method of any prior embodiment, wherein analyzing includes generating a composite return flow parameter including a plurality of different return flow parameters, and identifying the ballooning event based on the composite return flow parameter.

In connection with the teachings herein, various analyses and/or analytical components may be used, including digital and/or analog subsystems. The system may have components such as a processor, storage media, memory, input, output, communications link (wired, wireless, pulsed mud, optical or other), user interfaces, software programs, signal processors and other such components (such as resistors, capacitors, inductors, etc.) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user, or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

What is claimed is:

1. An apparatus for estimating properties of an earth formation, the apparatus comprising:

a carrier configured to be deployed in a borehole in the earth formation, the carrier connected to a drilling assembly configured to perform a drilling operation that includes including injection of fluid into a borehole;

a sensor assembly configured to measure at least one return flow parameter of a return fluid at a surface location, the return fluid returning to the surface location from the borehole, wherein the sensor assembly measures the at least one return flow parameter of flowback coming out of the borehole after pumps of the drilling operation have stopped; and a processor configured to perform:

receiving one or more return flow parameter values of the flowback for a period of time after injection of fluid is stopped;

analyzing the one or more return flow parameter values to identify a ballooning event;

in response to identifying the ballooning event, estimating at least one of a location and a property of one or more fractures in the formation; and performing one or more aspects of at least one of the drilling operation and a subsequent operation based on at least one of the location and the property of one or more fractures, wherein the processor is configured to receive one or more return flow parameter values for each of a plurality of periods of time and estimate a return flow parameter magnitude for each period of time, each period of time associated with a different borehole depth interval, and analyzing includes comparing a magnitude of the one or more return flow parameter values for the period of time to the return flow parameter magnitude associated with one or more other periods of time, and wherein analyzing includes estimating at least one of a ratio and a difference of the magnitude of the one or more return flow parameter values to a reference value, and identifying the ballooning event based on the ratio and/or the difference being equal to or greater than a selected threshold.

2. The apparatus of claim 1, wherein the at least one return flow parameter includes at least one of flow rate, return flow volume and volume of fluid in a fluid source.

3. The apparatus of claim 1, wherein the processor is configured to compare a magnitude of the one or more return flow parameter values to a selected threshold, identify the ballooning event based on the magnitude being equal to or greater than the selected threshold, and estimating at least one of a size and an extent of the one or more fractures based on the magnitude of the one or more return flow parameters.

4. The apparatus of claim 1, wherein analyzing includes determining a pattern of the one or more return flow parameter values, and comparing the pattern to a selected pattern associated with the ballooning event.

5. The apparatus of claim 1, wherein performing the one or more aspects includes evaluating parameters of the drilling operation during drilling, the parameters including at least one of the size and type of materials circulated into the borehole, evaluating productive zones in the formation during drilling, and monitoring borehole integrity during drilling.

6. The apparatus of claim 1, wherein performing the one or more aspects includes at least one of monitoring and adjusting managed pressure drilling (MPD) parameters during the drilling operation.

7. The apparatus of claim 1, wherein analyzing includes estimating at least one of a size and an extent of the one or more fractures based on the ratio and/or the difference.

8. The apparatus of claim 1, wherein analyzing includes generating a composite return flow parameter including a plurality of different return flow parameters, and identifying the ballooning event based on the composite return flow parameter.

9. A method of estimating properties of an earth formation, the method comprising:

deploying a carrier in a borehole in the earth formation, and performing a drilling operation that includes injection of fluid into a borehole;

measuring at least one return flow parameter of a return fluid at a surface location for a period of time after injection of fluid is stopped, the return fluid returning to the surface location from the borehole, wherein the at least one return flow parameter is a parameter of flowback coming out of the borehole after pumps of the drilling operation have stopped;

receiving one or more return flow parameter values of the flowback at a processor, and analyzing the one or more return flow parameter values to identify a ballooning event;

in response to identifying the ballooning event, estimating at least one of a location and a property of one or more fractures in the formation; and performing one or more aspects of at least one of the drilling operation and a subsequent operation based on at least one of the location and the property of one or more fractures.

10. The method of claim 9, wherein the at least one return flow parameter includes at least one of a flow rate, a return flow volume and a volume of fluid in a fluid source.

11. The method of claim 9, wherein analyzing includes comparing a magnitude of the one or more return flow parameter values to a selected threshold, and identifying the ballooning event based on the magnitude being equal to or greater than the selected threshold.

12. The method of claim 11, further comprising estimating at least one of a size and an extent of the one or more fractures based on the magnitude of the one or more return flow parameters.

13. The method of claim 9, wherein analyzing includes determining a pattern of the one or more return flow parameter values, and comparing the pattern to a selected pattern associated with the ballooning event.

14. The method of claim 9, wherein the processor is configured to receive one or more return flow parameter values for each of a plurality of periods of time, and analyzing includes estimating a return flow parameter magnitude for each period of time, each period of time associated with a different borehole depth interval.

15. The method of claim 14, wherein analyzing includes comparing a magnitude of the one or more return flow parameter values for the period of time to the return flow parameter magnitude associated with one or more other periods of time.

16. The method of claim 15, wherein analyzing includes estimating a ratio of the magnitude of the one or more return flow parameter values to a reference value, and identifying the ballooning event based on the ratio being equal to or greater than a selected threshold.

17. The method of claim 16, wherein analyzing includes estimating at least one of a size and an extent of the one or more fractures based on the ratio.

18. The method of claim 9, wherein analyzing includes generating a composite return flow parameter including a plurality of different return flow parameters, and identifying the ballooning event based on the composite return flow parameter.

* * * * *